US005167918A

United States Patent [19]

Shin et al.

[11] Patent Number: 5,167,918

[45] Date of Patent: Dec. 1, 1992

[54] MANUFACTURING METHOD FOR ALUMINUM-LITHIUM ALLOY

[75] Inventors: Myung Chul Shin; Keun Yong Sohn, both of Seoul, Rep. of Korea

[73] Assignee: Agency For Defence Development, Daejeon, Rep. of Korea

[21] Appl. No.: 755,520

[22] Filed: Sep. 6, 1991

Related U.S. Application Data

[63] Continuation-in-part of Ser. No. 556,896, Jul. 23, 1990, abandoned.

[51] Int. Cl.[5] ..... C22C 1/02; C22C 21/00

[52] U.S. Cl. ..... 420/528; 420/590; 75/686

[58] Field of Search ..... 420/528, 590; 75/686

[56] References Cited

U.S. PATENT DOCUMENTS

| | | | |
|---|---|---|---|
| 4,248,630 | 2/1981 | Balmuth | 420/590 |
| 4,556,535 | 12/1985 | Bowman et al. | 420/528 |
| 4,567,936 | 2/1986 | Binczewski | 164/453 |
| 4,607,679 | 8/1986 | Tsai et al. | 164/5 |
| 4,610,295 | 9/1986 | Jacoby et al. | 164/5 |
| 4,628,985 | 12/1986 | Jacoby et al. | 164/72 |
| 5,091,149 | 2/1992 | Shin et al. | 420/528 |

FOREIGN PATENT DOCUMENTS 62-01744 1/1987 Japan .

*Primary Examiner*—R. Dean
*Assistant Examiner*—Margery S. Phipps
*Attorney, Agent, or Firm*—Darby & Darby

[57] ABSTRACT

A manufacturing method for the production of aluminum-lithium alloys at low cost is disclosed which includes enclosing lithium with aluminum by means of a cold extrusion of pure lithium and melting the aluminum-sealed lithium ingots in an ambient atmospheric condition. The extrusion process can be simply performed in air as well as in an inert atmosphere at room temperature. The atmospheric melting of aluminum-lithium alloys is performed by immersing and agitating aluminum-sealed lithium ingots beneath the surface of molten aluminum with a graphite plunger.

7 Claims, 2 Drawing Sheets

MANUFACTURING METHOD FOR ALUMINUM-LITHIUM ALLOY

This application is a continuation-in-part of copending U.S. Ser. No. 07/556,896, filed on Jul. 23, 1990, now abandoned.

This application is related to co-pending application U.S. Ser. No. 07/673,146, filed on Mar. 21, 1991, now U.S. Pat. No. 5,091,149 entitled "Manufacturing Method of Aluminum-Lithium Alloy by Atmospheric Melting".

BACKGROUND OF THE INVENTION

1. Field of the Invention

The present invention relates to an economical process for the production of aluminum-lithium alloys. More particularly, this invention relates to the manufacturing process of aluminum-lithium alloys by use of an aluminum-sealed lithium ingot which is made by cold extrusion of pure lithium into an aluminum container. This aluminum-sealed lithium ingot prevents highly reactive lithium from oxidation in atmosphere and thus enables an atmospheric melting of aluminum-lithium alloys.

2. Description of the Prior Art

Lithium has a specific gravity of 0.534, which is the lowest value of all metals and alloys. Pure solid lithium is so ductile that it can be easily cut and worked at room temperature. Lithium is an extremely reactive material, so that it is easily oxidized when exposed to atmosphere. This reactive property gives a difficulty in control of this material in an atmosphere.

The addition of lithium to aluminum gives promising effect of a considerable improvement of specific strength and specific modulus making this alloy system extremely attractive to the aerospace industry. It has been known that the addition of each wt % lithium results in a 3% reduction in density and a 6% increase in the Young's modulus. One alloy, recently registered as 2090, which has been introduced as a replacement for 7075-T6 products achieves a potential weight saving of 8 to 10%.

However, there are many difficulties in the fabrication of aluminum-lithium alloys. In the production of aluminum base alloys, it is common to practice melting and casting in an open atmosphere and add the alloying elements in the form of a master alloy or pure metals. Because of the high reactivity of lithium, however, aluminum-lithium alloys are difficult to melt and cast and also possess poor mechanical properties when processed by conventional ingot making method.

In conventional process, the loss of lithium due to its rapid oxidation rate is undesirably high (over 20%). This, therefore, makes it difficult to control the composition of these alloys and the process is not economical. At present, thus, it is generally known that the manufacturing process of aluminum-lithium alloys is entirely performed in an inert atmosphere.

As a method for producing aluminum-lithium alloys, it was proposed in U.S. Pat. No. 4,556,535 to fabricate these alloys by a process which comprises introducing molten lithium beneath the surface of an agitated source of molten aluminum while bubbling a mixture of argon and chlorine gases through the molten metal mixture and continuously casting an aluminum-lithium alloy ingot while monitoring the ingot casting rate.

The manufacturing process like this, however, requires high cost in planting and processing because an inert atmosphere must be kept throughout the process. Sophisticated technical knowhow and some complicated techniques are also required to operate the system. In this regard, a fabricating method of high quality aluminum-lithium alloys at low cost is necessitated.

SUMMARY OF THE INVENTION

It is, therefore, an object of the present invention to provide a cheap and easy process for the production of aluminum-lithium alloys with high quality.

A further object of the present invention is to provide a process for the production of aluminum-sealed lithium ingot which prevents lithium from oxidation in open air and thus makes it possible to try open air melting and casting practices of aluminum-lithium alloys.

The present invention provides a method for the production of aluminum-lithium alloys at low cost including enclosing lithium with aluminum so that it can be easily handled in an open atmosphere.

The present invention also provides a method for the production of aluminum-sealed lithium ingot by means of a cold extrusion of pure lithium. This process can be simply performed in air as well as in an inert atmosphere at room temperature minimizing the oxidation of lithium.

The present invention also provides a method of atmospheric melting of aluminum-lithium alloys including immersing aluminum-sealed lithium ingots beneath the surface of molten aluminum with a graphite plunger.

With the present invention, the lithium loss can be reduced to 4–6% by atmospheric melting, which is considered to be a remarkable advance in the art and is a promising result in producing aluminum-lithium alloys.

DETAILED DESCRIPTION OF THE INVENTION

The present invention comprises three sections in describing the manufacturing process of aluminum-lithium alloys, including an extrusion process in which pure lithium is extruded into an aluminum container, a sealing process of an aluminum container charged with the lithium and an atmospheric melting process by use of the aluminum-sealed lithium ingots. The term "aluminum" of the "aluminum container" includes the meanings of aluminum alloys as well as pure aluminum.

Figure 1:
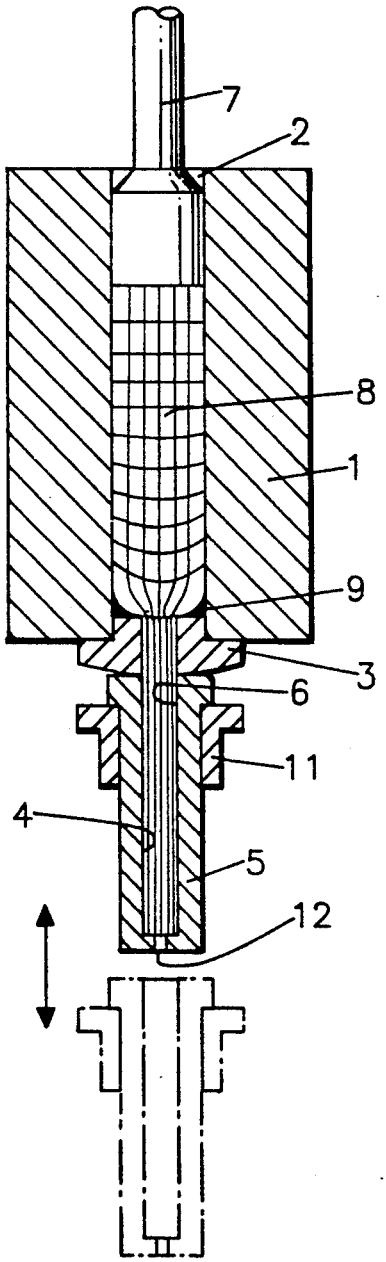
FIG. 1 is a schematic view of the vertical cross section showing the extrusion process of the invention.

Referring now to FIG. 1, an extrusion process is illustrated for the purpose of describing the fabrication of an aluminum-sealed lithium ingot of the invention. As shown in FIG. 1, pure lithium 8 is installed in the interior 2 of a cylinder 1 and then extruded by a piston 7. The extruded pure lithium through a die 3 is charged into the interior 6 of an aluminum container 5 which is closely contacted with a die hole 4. When lithium is extruded in an atmosphere, the oxidation of extruded lithium could be minimized by flowing an inert gas through a hole 12 into the container 5 sustained by a fixture 11. The oxidized surface of lithium formed prior to or during installation could be removed by the scalping action during the process and remained as a dead metal 9 at the final stage of the extrusion. If mineral oil is used together, the oxidation of lithium during installation prior to extruding is not severe at room temperature even in an atmosphere.

Figure 2:
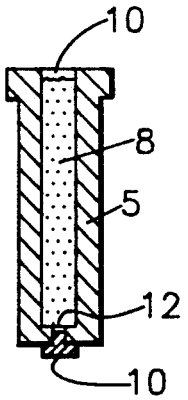
FIG. 2 shows a vertical cross section of the aluminum-sealed lithium ingot made by extrusion process.

FIG. 2 shows a vertical cross section of the aluminum-sealed lithium ingot. In FIG. 1, an aluminum container 5 charged with lithium 8 by extrusion is removed from the extrusion apparatus and then whose entrance and a gas flow hole 12 is sealed by aluminum sealant 10. The entrance and the gas hole 12 of the aluminum container can be sealed not only by pressing an aluminum plate or sheet of similar size to the entrance of the container but also by using an adhesive aluminum tape. The aluminum-sealed lithium ingot fabricated by the method of the present invention can be easily handled in an atmosphere without further oxidation of lithium. This aluminum-sealed lithium ingot could be used not only in an original state but also in a mechanically deformed state by such a process as rolling, drawing, etc. so that it may be used in an appropriate size by cutting without exposure of lithium to open air.

Figure 3:
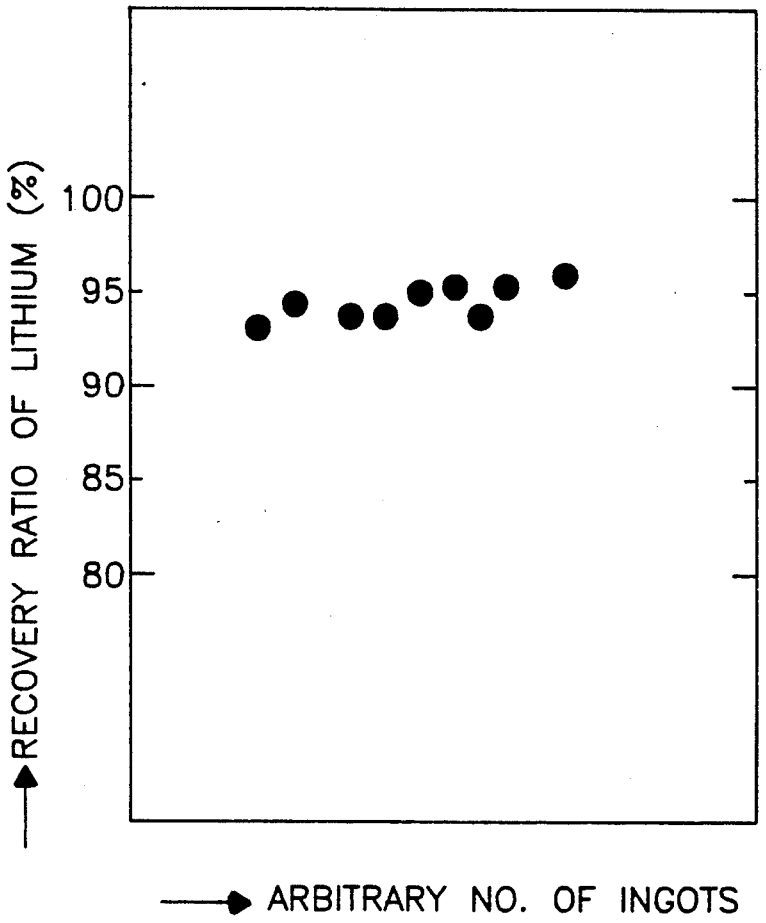
FIG. 3 is a graphical illustration showing the recovery ratio of lithium of aluminum-lithium ingot fabricated by atmospheric melting of the invention.

FIG. 3 is a graphical illustration showing the recovery ratio of lithium of aluminum-lithium ingot fabricated by atmospheric melting with aluminum-sealed lithium ingot of the invention. The atmospheric melting of aluminum-lithium alloys was performed by immersing and agitating aluminum-sealed lithium ingots beneath the surface of molten aluminum with a graphite plunger. The charging amount of raw materials was about 20 kg. To minimize oxidation reactions, molten salt flux, LiCl, was covered on the molten metal. Degassing was accomplished by bubbling an inert gas through the melt. After the degassing, the molten metal was immediately poured into an iron mold. Pouring temperature was in the range of about 780°–800° C. With the results, the lithium loss can be reduced to 4–6% by atmospheric melting of the invention, which is considered to be a remarkable advance in the art and is a promising result in producing aluminum-lithium alloys. If the production scale is increased more, the amount of lithium loss may be reduced further. Mechanical properties were also relatively reasonable.

Thus, the invention provides a process for the production of aluminum-lithium alloys by atmospheric melting with an aluminum-sealed lithium ingot which prevents lithium from oxidation in open air. The fabrication of aluminum-sealed lithium ingot can be easily accomplished by the extrusion method, which is possible at room temperature with a press of low capacity because of the good workability of lithium. For example, an aluminum-sealed lithium of 2" dia×5" long cylinder containing about 100 grams of lithium can be fabricated at room temperature with a press having a capacity of several tons. The extrusion process can be performed not only in an inert atmosphere but also even in open air without marked oxidation of lithium at room temperature. Proper use of mineral oil makes the oxidation of lithium become minimum during extrusion in an open air. Therefore, the use of the extrusion process for fabricating aluminum-sealed lithium ingot would lower the production cost. The extrusion process also has a stability in controlling the amount of lithium to be added to molten aluminum. Noticeable facts are that the oxidation loss of lithium during open air melting of aluminum-lithium alloys with these aluminum-sealed lithium ingots is not severe and relatively even, whose results are very encouraging to the fabrication of these alloys. The atmospheric melting of the invention may be performed under the flowing of an inert gas over aluminum alloy melt.

What is claimed is:

1. A method for manufacturing aluminum-lithium alloys which comprises (a) extruding a solid state lithium metal directly into the interior of an aluminum container, (b) sealing said aluminum container with an aluminum metal to form an aluminum-sealed lithium ingot, (c) adding said aluminum-sealed lithium ingot to a molten aluminum alloy and (d) melting said aluminum-sealed lithium ingot under ambient atmospheric conditions.

2. The method of claim 1, wherein said steps (a) and (b) of extruding and sealing include performing the process in either an ambient atmosphere or an inert atmosphere.

3. The method of claim 1, wherein said step (a) of extruding includes flowing an inert gas into said aluminum container.

4. The method of claim 1, wherein said step (b) of sealing includes pressing an aluminum plate or sheet on the container.

5. The method of claim 1, wherein said step (b) of sealing further includes adhering an adhesive aluminum tape to said container.

6. The method of claim 1, wherein said steps (c) and (d) of adding and melting include adding said aluminum-sealed lithium ingot into aluminum melt with a graphite plunger either in open air or in an inert gas.

7. The method of claim 1, wherein said steps (c) and (d) of adding and melting include degassing by an inert gas.

* * * * *